US005470038A

United States Patent [19]

Clark

[11] Patent Number: 5,470,038

[45] Date of Patent: Nov. 28, 1995

[54] SELF-STABILIZING SEAT SUPPORT

[76] Inventor: R. John Clark, 221 Strathmore Dr., Syracuse, N.Y. 13207

[21] Appl. No.: 108,054

[22] Filed: Aug. 17, 1993

[51] Int. Cl.[6] ..... A45F 3/44

[52] U.S. Cl. ..... 248/156; 248/530; 248/170; 248/188.5; 248/188.7

[58] Field of Search ..... 248/156, 188.5, 248/188.7, 530, 532, 170, 519, 528, 533

[56] References Cited

U.S. PATENT DOCUMENTS

| | | | |
|---|---|---|---|
| 506,255 | 10/1893 | Reutter . | |
| 2,137,799 | 5/1937 | Brandenburg . | |
| 2,675,256 | 4/1954 | Cornell | 248/188.5 X |
| 2,720,249 | 10/1955 | Peterson | 248/156 |
| 2,800,164 | 7/1953 | Chambers . | |
| 3,058,711 | 10/1962 | Kingsford . | |
| 4,326,352 | 4/1982 | Barth | 248/156 X |
| 4,712,762 | 12/1987 | Liedle | 248/156 X |
| 4,744,536 | 5/1988 | Bancalari | 248/188.7 X |

*Primary Examiner*—Alvin C. Chin-Shue
*Assistant Examiner*—Derek J. Berger

[57] ABSTRACT

A portable, self-stabilizing folding seat support for use on ground conditions of various consistencies comprising a rigid main shaft, a plurality of pivoting stabilizer feet and stabilizer feet brackets attached to the base of the main shaft, and an adjustable stabilizer shaft which can be extended beyond the base of the main shaft and pivoting stabilizer feet to various positions. A removable stabilizer shaft cross bolt is used to fix the adjustable stabilizer shaft in various degrees of extension in relation to the main shaft and stabilizer feet, and a retention leash flexibly attaches the stabilizer shaft cross bolt to the main shaft and prevents its loss. The seat support may be used to provide a self-stabilizing seating platform on soft unstable ground conditions by vertically thrusting the extended stabilizer shaft into the soft ground or mud so that the extended stabilizer feet engage the soft surface. The seat support may be used to provide a self-stabilizing seating surface on hard ground or floors by extending the stabilizer feet and placing the seat support directly on the hard surface without extending the stabilizer shaft beyond the base of the main shaft and stabilizer feet.

11 Claims, 2 Drawing Sheets

SELF-STABILIZING SEAT SUPPORT

BACKGROUND—FIELD OF INVENTION

This invention relates to folding outdoor seats, specifically an improved support for folding seats which can be used to provide a self-stabilizing portable seat for people engaged in outdoor activities.

BACKGROUND—DESCRIPTION OF PRIOR ART

Many outdoor activities are conducted in locations which have very soft, unstable ground or bottom conditions. Often these locations have several feet of water present and have a very soft, unstable mud or sand bottom.

For example, most duck hunting is conducted in marshes and swampy areas which usually have a water depth of three (3) feet or less. Duck hunters generally take up positions standing in the water and reeds which surround the shallow edges of these marshy areas.

These marshes usually have a very soft muck or mud bottom in which the hunter: sink to a depth of four (4) to twelve (12) inches. In addition, this soft mud or muck bottom is usually covered by water from one (1) to three (3) feet deep. Hunters must usually stand for long periods while hunting because the water and soft, unstable bottom conditions prohibit the use of existing seats which quickly sink into the soft bottom when sat on. As a result, standing for long periods is often an unavoidable inconvenience of this outdoor activity.

Similarly, surf and other shore fishermen must often stand while fishing because existing seats sink into the soft sand, gravel or mud bottom typically present. Wave action in these areas also contributes to unstable bottom conditions. Deep snow also prevents the use of existing seats due to its poor weight-bearing ability.

Several inventors have created portable outdoor folding seats which can also double as canes and/or walking sticks. As their dual purpose use as both a seat and as a cane or walking stick suggests, these seats were designed for use on firm, dry surfaces and are unusable in the conditions in which my seat can be used.

Existing seats basically consist of a single support shaft of appropriate length with a seat member mounted at the upper end. The lower or ground engaging end of the support shaft utilizes a small spike or disc designed only to prevent the seat from slipping out from under the user on floors and other firm surfaces on which these seats are intended for use.

Current seats are not self-stabilizing and require the user to utilize his or her legs to balance the seat in an upright, weight-bearing position. When the user stands up, existing designs immediately fall over or are easily tipped over by slight disturbances.

U.S. Pat. No. 506,255 to Reutter (Oct. 10, 1893) discloses a portable folding camp stool which can also be configured for use as a cane. It consists of two rigid interlocking tubular support members. The upper member consists of a rigid hollow tapering tube; a flexible folding seat member; and support tines which can be folded and stored within the hollow interior of the upper member. The lower member consists of a tapering tube, the widest end of which incorporates several small tines. When used as a seat, the tapering end of the lower member is wedged into the open end of the upper member such that the tines on the lower member provide a small base. The flexible seat and associated support tines extend from the upper member to provide a seating surface.

When used as a cane, the seat member and its support tines as well as the base tines are collapsed and stored within the interior of their respective support members. Because of the small fixed surface area presented by its base, this seat can only be used on hard, weight-bearing surfaces such as floors or hard packed dry ground. If used on the soft unstable ground conditions contemplated with regard to my seat, it would immediately sink under the user's weight and be rendered unusable.

British patent 255,214 to Palmer (Jul. 22, 1926) discloses a portable revolving seat for use on hard ground. It consists of a curved metal or wooden detachable seating member mounted atop a rigid shaft. Attached to the lower end of the shaft is a small fixed flange to engage the hard ground surface on which the stool was intended for use. Again this design can only be used on relatively hard weight-bearing surfaces and is not in and of itself free-standing. It requires the user to utilize his or her legs to balance the seat in an upright, weight bearing position. When the user stands up, the seat immediately falls over or is easily tipped over by any disturbance.

British patent 296,562 to Jennens, et al. (Sep. 6, 1928) discloses an improvement to folding seats of the cane or walking stick type. Jennens noted that prior combination seats and canes required the removal of the ground-engaging apparatus in order to convert the seat for use as a cane. In order to obviate the need for removal of the ground engaging apparatus, Jennens design consists of two (2) small hinged plates which are attached directly to a tubular support shaft by means of a hinge bolt which passes directly through and obstructs the interior of the support shaft. When being used as a cane the small plates lie closely along the sides of the support shaft resulting in a streamlined, low profile that does not interfere with the user's legs. When used as a seat the two (2) small plates are extended horizontally to provide a ground engaging surface. Again, Jennens can only be used on firm surfaces and like its predecessors it is not free-standing and requires the user to utilize his or her legs to balance the seat in an upright, weight-bearing position.

U.S. Pat. No. 2,137,799 to Brandenburg (Nov. 22, 1938) discloses a folding seat consisting of a flexible triangular seat member mounted on a tubular member the length of which is adjustable. This adjustable feature allows only for the adjustment of the height of the seat member above the hard surface on which the folding seat rests in order to accommodate users of different heights and to allow the seat to be collapsed to a compact size when not in use. The ground is engaged by a small ground peg and plate or suction cup arrangement which is attached to the base of the lower tube. The ground peg is utilized on hard ground applications to prevent the chair from slipping out from under the user and the removable suction cup is utilized on wood or other smooth impenetrable surfaces to achieve the same purpose.

U.S. Pat. No. 2,800,164 to Chambers (Jul. 23, 1957) discloses an improvement to portable seats of the type described above. It includes a folding seat unit consisting of a flexible seat member suspended between two (2) hinged seat frames. The folding seat unit is mounted on a tubular member the length of which is adjustable as in Brandenburg, to accommodate individuals of various heights and to allow the seat to be collapsed to a compact size when not in use. As in Brandenburg the lower, ground-engaging end of the seat consists of a small ground spike and plate which are attached to the base of the lower tube. The ground-engaging apparatus can also accommodate a non-skid cap for use on smooth floor-like surfaces. Like other designs, the ground-engaging apparatus is only useful to prevent the seat from slipping out from under the user. The ground spike and plate are small so that they do not interfere with the users legs when the seat is used as a cane or walking stick. Like other designs, when used as a seat the user must utilize his or her legs to balance the seat in an upright, weight-bearing position or else the seat and the user fall over.

U.S. Pat. No. 3,058,711 to Kingsford (Oct. 16, 1962) discloses a collapsible stool which also converts to a cane or hiking staff. It consists of a folding seat member mounted atop a series of adjustable interconnecting tubular members. As in Brandenburg and Chambers, this adjustment feature allows only for the adjustment of the height of the folding seat member above the ground to accommodate users of different heights. The ground is engaged by a small spike and plate arrangement attached to the lower tube which can be removed for use on scratchable surfaces. Like all other designs, the seat is not self-stabilizing and falls over unless balanced in an upright, weight-bearing position by the user.

BACKGROUND—DISADVANTAGES OF PRIOR ART

All of the folding seats heretofore known suffer from a number of disadvantages which renders them unusable in the soft, unstable ground conditions in which my seat can be used. For example:

(a) existing seats are not self-stabilizing and require the user to utilize his or her legs to balance the seat in an upright weight-bearing position;

(b) as soon as the user stands up, existing seats immediately fall over or are easily knocked over by any disturbance;

(c) existing seats lack sufficient support and stabilizing features for use on soft unstable ground and bottom conditions;

(d) the ground-engaging apparatus of existing seats is attached in such a manner that the interior of the support shaft is obstructed and therefore unable to accommodate additional support and stabilizing features;

(e) the design of existing seat supports limits the number of ground-engaging and/or stabilizing features which can be incorporated or attached, and prohibits existing seats from being self-stabilizing;

(f) existing seats cannot be used in shallow water aquatic environments as the design of their ground-engaging apparatus is inadequate to provide any significant weight-bearing or stabilizing ability. As a result, when sat on, current seats sink uncontrollably into the soft mud or muck bottom typical of these environments;

(g) the ground engaging end of existing seats consists of a small spike and/or plate intended only to keep the seat from slipping out from under the user on hard or firm surfaces;

(h) existing designs allow only for the adjustment of the height of the seat member above the ground to accommodate users of various heights or to facilitate compact storage;

(i) the small ground spike of existing designs is not adjustable in its degree of extension beyond the base of the support shaft and provides no stabilization or support;

(j) existing seats have no means of adjusting the degree of extension of the ground spike beyond their respective ground-engaging apparatus in order to accommodate ground or bottom conditions of differing consistencies;

(k) ground plates and discs on existing designs do not stabilize current seats in an upright weight-bearing position;

(l) ground plates and discs on existing designs make current seats difficult if not impossible to extract from soft mud and other penetrable ground and/or bottom conditions;

(m) existing seats require the removal or attachment of accessories for use on various surfaces;

(n) existing seats lack the flexibility to be adaptable for use on hard as well as soft unstable ground;

(o) existing seats are not self-stabilizing whether used on hard or soft, unstable ground conditions;

(p) existing folding seat designs are inherently unstable;

(q) existing seats can only be used on dry, relatively hard surfaces such as floors or hard-packed ground;

(r) no combination of existing designs contains all the features or produces all the advantages of my seat.

PRESENT INVENTION—OBJECTS AND ADVANTAGES

Accordingly, besides the objects and advantages of the outdoor seat described in my above patent, several objects and advantages of the present invention are:

(a) to provide a seat which is self-stabilizing under all ground conditions and which does not require the user to utilize his or her legs to balance the seat in an upright weight-bearing position;

(b) to provide a seat that does not fall over as soon as the user stands up, or in response to minor disturbances;

(c) to provide a seat with sufficient support and stabilizing features to enable it to be used on soft unstable ground conditions;

(d) to provide a seat, the ground-engaging apparatus of which does not obstruct the interior of the support shaft in order to allow for the accommodation of additional support and stabilizing features;

(e) to provide a seat support which increases the number of ground-engaging and/or stabilizing features which may be incorporated or attached in order to provide a completely self-stabilizing seat;

(f) to provide a seat which can be used in shallow water aquatic environments to provide a stable weight-bearing seating platform;

(g) to provide a seat whose ground-engaging apparatus is adjustable to stabilize the seat under a variety of ground conditions;

(h) to provide a seat whose ground-engaging apparatus stabilizes the seat in an upright position;

(i) to provide a seat whose ground-engaging apparatus allows for the easy removal of the seat from mud and other soft ground and/or bottom conditions;

(j) to provide a seat which does not require the removal or attachment of accessories in order to use the seat on various surfaces;

(k) to provide a seat which can be adapted for use on hard as well as soft, unstable ground conditions;

(l) to provide a seat which is self-stabilizing whether used on hard, firm surfaces or on soft, unstable ground conditions;

(m) to provide a seat which incorporates a ground-engaging apparatus which is inherently stable under a variety of ground conditions;

(n) to provide a seat which can be used in shallow water aquatic environments as well as on hard, dry surfaces such as floors and hard-packed ground.

DRAWING FIGURES

In the drawings submitted herewith, closely related parts have the same numeric prefix but different alphabetic suffixes.

REFERENCE NUMERALS IN DRAWINGS

| | |
|---|---|
| Stabilizer Shaft - 10 | Cross Bolt Hole - 23 |
| Main Shaft - 11 | Cross Bolt Nut - 24 |
| Seat Base Unit - 12 | Retention Leash - 25 |
| Seat Base Unit Bolt - 13 | Stabilizer Foot Bracket - 26 |
| Seat Base Unit Nut - 14 | Screw - 27 |
| Flange - 15 | Collar - 28 |
| Seat Hinge Pin - 16 | Stabilizer Shaft Adjustment Hole - 29 |
| Seat Frame - 17 | Stabilizer Foot - 30 |
| Seat Frame Ears - 18 | Stabilizer Foot Ears - 31 |
| Cross Member - 19 | Stabilizer Foot Hinge Bolt - 32 |
| Flexible Seat Member - 20 | Stabilizer Foot Nut - 33 |
| Stop - 21 | Inner Edge - 34 |
| Stop - 21A | Lateral External Surface - 35 |
| Stop - 21B | Guide Tube - 36 |
| Cross Bolt - 22 | |

DESCRIPTION—FIGS. 1 TO 5 a. Internally Mounted Stabilizer Shaft Configuration

Figure 1:
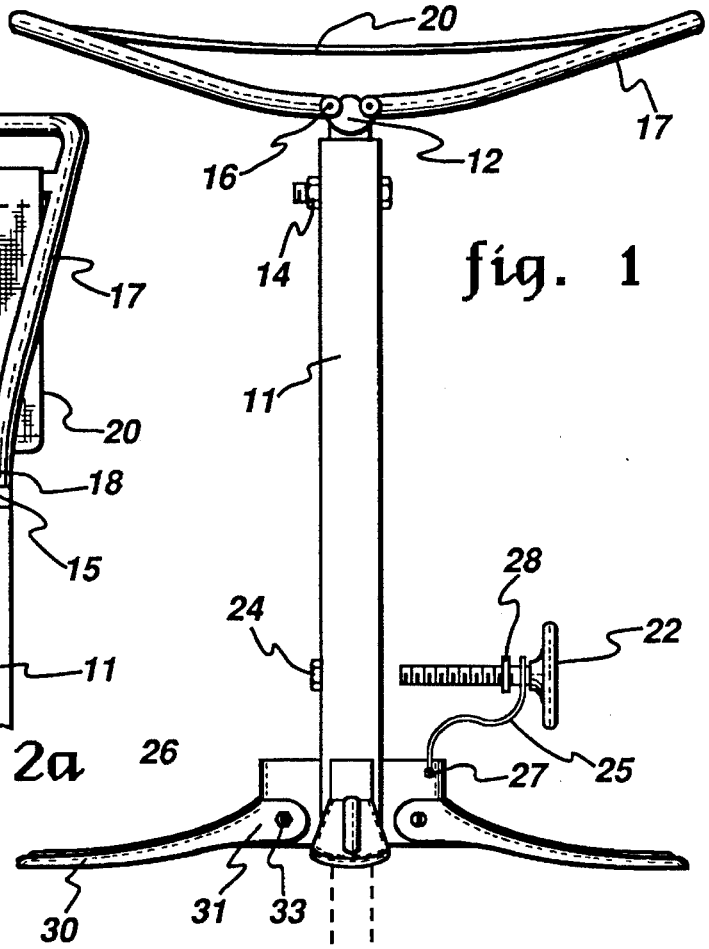
FIG. 1 shows a side elevation of the invention with a prior art folding seat unit attached to the upper end in the open position, the stabilizer feet in the fully extended position, and the stabilizer shaft in the fully retracted position. The fully extended position of the stabilizer shaft is also shown in broken lines.

FIG. 1 shows a side elevation of the preferred embodiment of the present invention with a stabilizer shaft 10 shown in broken lines fully extended from the base of a main shaft 11. The preferred embodiment utilizes a square hollow main shaft 11 and a square hollow stabilizer shaft 10, however round, triangular or other shapes can be used as well as different combinations of these shapes. Main shaft 11 and stabilizer shaft 10 and other components hereinafter described can be composed of metal, wood, plastic, composite materials such as graphite or fiberglass or other sufficiently rigid material.

Main shaft 11 is of sufficient length to support a seating surface at a comfortable height for a seated human. Stabilizer shaft 10 is approximately the same length to allow it to be completely withdrawn up inside main shaft 11 as described below.

Figure 2A:
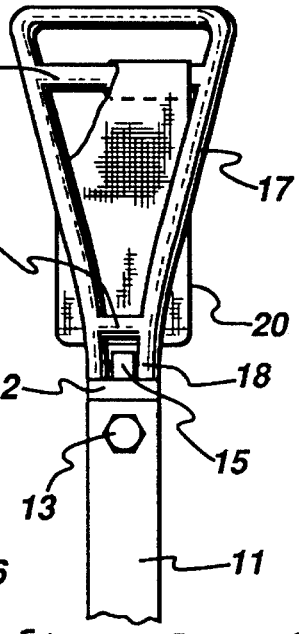
FIG. 2A shows a partial side elevation of the detail of the prior art folding seat unit which is attached to the upper portion of the invention.
Figure 2:
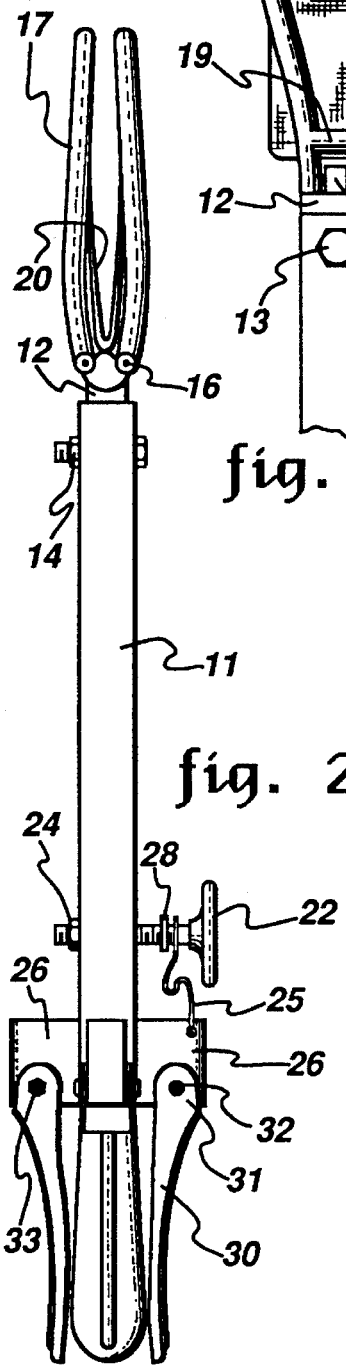
FIG. 2 is a side elevation showing the prior art folding seat, stabilizer feet and stabilizer shaft in the fully closed or retracted position.

Attached to the upper end of main shaft 11 is a folding seat unit similar to that of prior art such as Chambers (Jul. 23, 1957) described above. See also FIGS. 2A and 2. The folding seat comprises a seat base unit 12 which is partially inserted into the upper end of main shaft 11 and is secured there by a seat base unit bolt 13 and seat base unit nut 14. The upper portion of seat base unit 12 which extends above the upper end of main shaft 11 has two vertical flanges 15, each of which has a horizontal hole which supports a seat hinge pin 16, the ends of which extend from each side of its respective flange 15. Each of two (2) triangular shaped seat frames 17 has a pair of seat frame ears 18 extending from its narrowest end. Each seat frame ear 18 has a hole which receives a protruding end of a respective seat hinge pin 16 thereby providing a means of pivotally attaching each seat frame 17 to seat base unit 12.

Each seat frame 17 has at least one cross member 19 located toward the outer end of each seat frame 17 which provides both reinforcement and a means for attaching a wide flexible seat member 20. Each end of flexible seat member 20 is formed into a loop which passes around cross member 19 on each seat frame 17. When opposedly opened, seat frames 17 present flexible seat member 20 in a taut, extended position for use as a seating surface.

Figure 3:
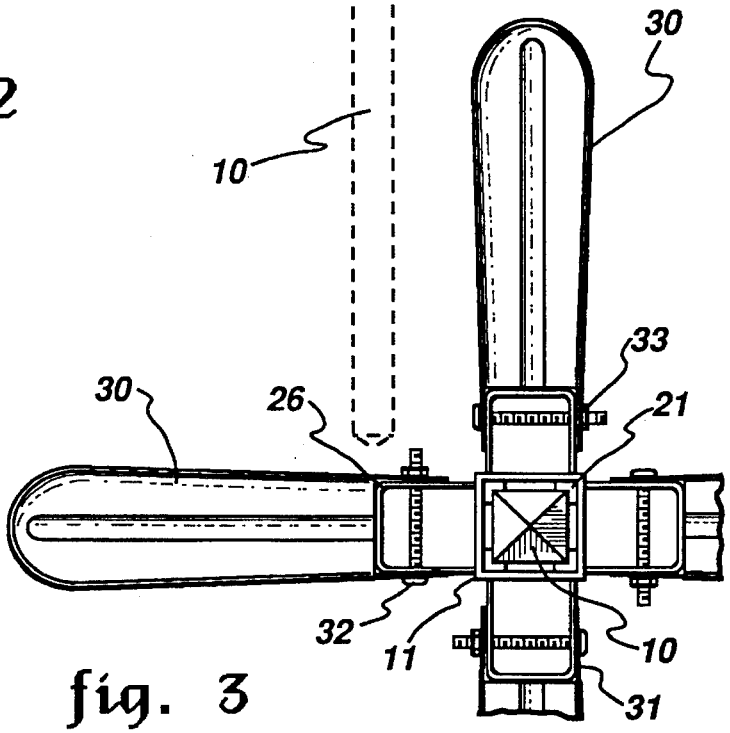
FIG. 3 shows a bottom view of the invention, partially cutaway, with the stabilizer feet in the fully extended position and the stabilizer shaft fully retracted within the main shaft.
Figure 4:
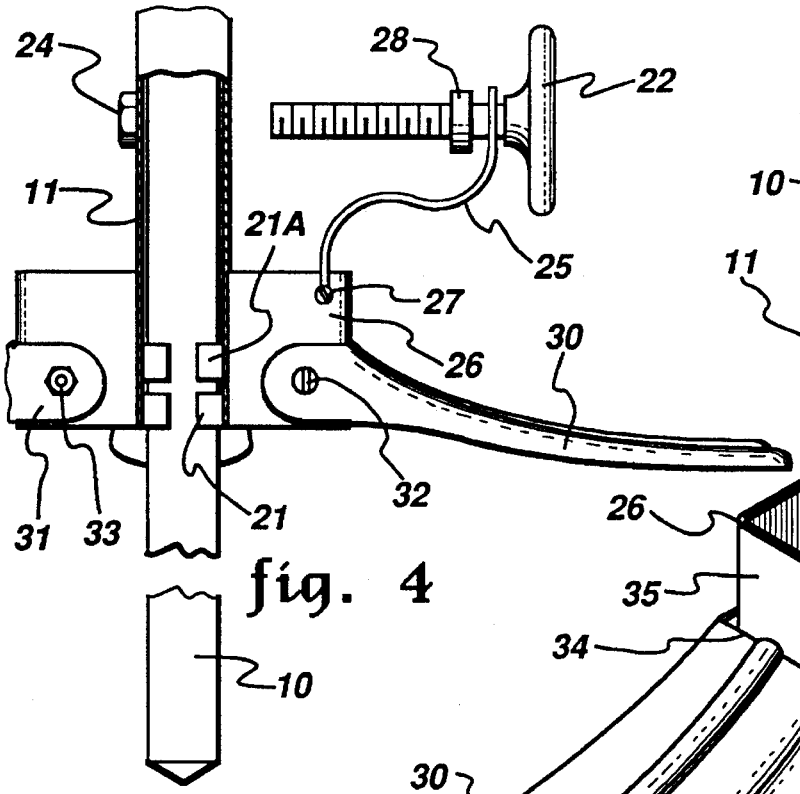
FIG. 4 shows a partial side elevation of the lower portion of the invention, partially cutaway, showing the detail of the orientation of the stabilizer shaft within the main shaft and the related stops.

FIG. 3 shows a bottom view of the invention, partially cutaway, illustrating the orientation of stabilizer shaft 10 within main shaft 11. Stabilizer shaft 10 is of a sufficiently small diameter to allow it to slide in and out from the base of main shaft 11. In the preferred embodiment, stabilizer shaft 10 is prevented from being removed from the base of main shaft 11 by one or more stops 21 which protrude from the internal surface of the opening at the base of main shaft 11. One or more corresponding stops 21A protrude from the external surface of the upper end of stabilizer shaft 10 and overlap stops 21. See also FIGS. 4 and 5.

In the preferred embodiment, stops 21 and 21A consist of small right angle pieces attached to the internal corners of the base of main shaft 11 and the external corners of the upper end of stabilizer shaft 10 respectively. In other embodiments stops 21 and 21A could consist of small pieces attached to the interior surface of the base of main shaft 11 and the exterior surface of stabilizer shaft 10. Stops 21 and 21A also function as guides which allow stabilizer shaft 10 to slide smoothly in and out of the base of main shaft 11 in a longitudinal fashion. When the preferred embodiment with a square main shaft 11 is utilized, stops 21 and 21A also help prevent stabilizer shaft 10 from rotating within main shaft 11. The lower end of stabilizer shaft 10 is formed into a point to facilitate insertion into soft ground in appropriate conditions. See FIGS. 1, 3, 4 and 5.

FIGS. 1, 2, 4 and 5 show side elevations and/or cutaway views of the means by which stabilizer shaft 10 may be adjusted to a variety of degrees of fixed extension beyond the base of main shaft 11 and stabilizer feet 30. A cross bolt 22 is comprised of a threaded bolt with a knob on one end. The threaded end of cross bolt 22 is inserted through cross bolt holes 23 in opposite sides of main shaft 11. A cross bolt nut 24 is attached to or incorporated into the side of main shaft 11 to receive the threaded end of cross bolt 22 and hold it in position. A retention leash 25 comprising a length of flexible cord or cable with a loop at each end prevents cross bolt 22 from being completely disconnected from the seat to avoid loss. One end of retention leash 25 is attached to the surface of main shaft 11 or a stabilizer foot bracket 26 by a screw 27 or other appropriate fastener. Cross bolt 22 passes through the loop at the other end of retention leash 25, and a collar 28 prevents cross bolt 22 from being separated from leash 25 and allows it to rotate within its respective loop.

Figure 5:
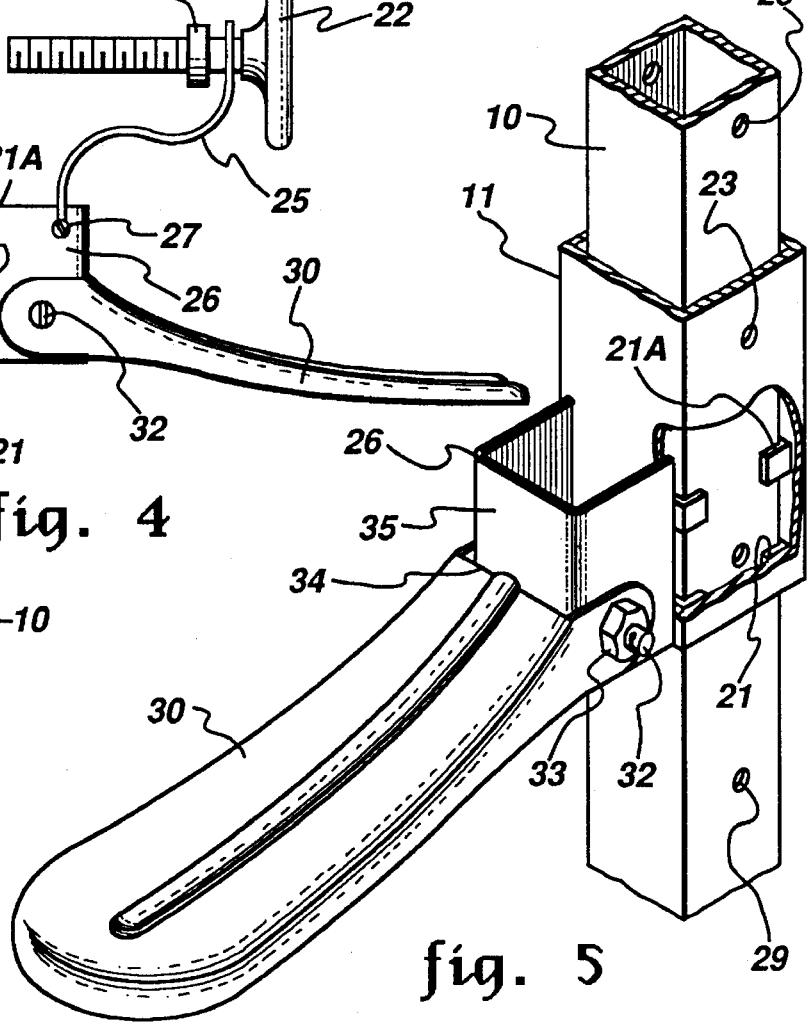
FIG. 5 is an isometric view, partially cutaway, of the lower portion of the invention showing the detail of the connection of the stabilizer feet to the stabilizer feet brackets and the orientation of the stabilizer shaft within the main shaft and related cross bolt holes and stops.

FIG. 5 is an isometric cutaway view showing further detail of the orientation of stabilizer shaft 10 within main shaft 11. Stabilizer shaft 10 has a plurality of pairs of adjustment holes 29 located at various positions along its length. By removing and reinsetting cross bolt 22 through cross bolt holes 23, adjustment holes 29 and cross bolt nut 24, stabilizer shaft 10 can be positively locked in a variety of positions ranging from fully retracted within main shaft 11 to fully extended beyond the base of main shaft 11 and stabilizer feet 30. By utilizing a square or other non-round configuration for main shaft 11 in conjunction with stops 21 and 21A, stabilizer shaft 10 cannot rotate within main shaft 11. As a result, adjustment holes 29 are automatically aligned with cross bolt holes 23 whether stabilizer shaft 10 is fully extended or retracted thereby facilitating the adjustment of stabilizer shaft 10. See also FIGS. 1, 2 and 4.

Stabilizer shaft 10 can be removed from main shaft 11 by removing seat base unit bolt 13 and detaching seat base unit 12 from the upper end of main shaft 11 through which stabilizer shaft 10 can then be removed.

The lower end of main shaft 11 has attached to it a plurality of stabilizer foot brackets 26. A large oblong shaped stabilizer foot 30 is pivotally attached to each stabilizer foot bracket 26. Each stabilizer foot 30 has a pair of parallel stabilizer foot ears 31 protruding from one end which straddle its respective stabilizer foot bracket. A stabilizer foot hinge bolt 32 passes through stabilizer foot ears 31 and stabilizer foot bracket 26 so that each stabilizer foot 30 can pivot downward in relation to main shaft 11. A stabilizer foot nut 33 keeps hinge bolt 32 in place. When fully extended upward, the inner edge 34 of each stabilizer foot 30 abuts the lateral external surface 35 of its respective stabilizer foot bracket 26 such that stabilizer foot 30 may be adjusted to positions more or less ranging from parallel to perpendicular to main shaft 11. See FIGS. 1, 2, 3, 4 and 5.

By utilizing stabilizer foot brackets 26 to attach stabilizer feet 30 to the external surface of main shaft 11, stabilizer feet 30 can be attached in multiple longitudinal planes in order to stabilize the invention in all vertical planes.

Because the stabilizer feet 30 are attached in multiple longitudinal planes, when extended perpendicular to main shaft 11 they form a large stable base which results in a self-stabilizing seat which does not require the user to utilize his or her legs to balance the seat in an upright weight-bearing position. In addition, this configuration leaves the interior of main shaft 11 unobstructed in order to accommodate stabilizer shaft 10 and related features.

Each stabilizer foot 30 is of sufficient size so that when they are fully extended perpendicular to main shaft 11, their combined surface area is sufficient to provide a large self-stabilizing base and to prevent the seat from sinking in the soft mud, snow, sand, etc. on which the seat is being utilized. When the seat is used on hard ground or floor-like surfaces, the fully extended stabilizer feet 30 provide a large base which maintains the seat in a very stable upright, weight-bearing position.

OPERATION—FIGS. 1 to 5 a. Internally Mounted Stabilizer Shaft Configuration

The manner of using my seat to provide a seating surface in swamps, mud, snow, sand or other soft, unstable ground conditions is to fully extend stabilizer feet 30 upward, perpendicular to main shaft 11. Next cross bolt 22 is withdrawn from main shaft 11 which allows stabilizer shaft 10 to be extended beyond the base of main shaft 11 and stabilizer feet 30. Adjustment holes 29 along the length of stabilizer shaft 10 allow the user to vary the degree of fixed extension of stabilizer shaft 10 beyond the base of main shaft 11 and stabilizer feet 30, appropriate for existing ground conditions. This is done by simply reinserting cross bolt 22 through cross bolt holes 23 so that it in turn passes through appropriate adjustment holes 29 in stabilizer shaft 10 and into cross bolt nut 24 thereby locking stabilizer shaft 10 in the desired position.

The softer and more unstable the ground is on which the invention is being used, the farther stabilizer shaft 10 is extended from the base of main shaft 11 and stabilizer feet 30 in order to provide additional support and stability. With stabilizer shaft 10 and stabilizer feet 30 fully extended, the invention provides a very stable base even on very soft unstable ground.

Seat frames 17 are then opposedly opened to present flexible seat member 20 in a weight-bearing position. The upright seat with stabilizer shaft 10 extended is then vertically thrust into the soft ground, snow, sand or mud a sufficient distance so that extended stabilizer feet 30 engage the soft surface. Stabilizer feet 30 prevent the seat from sinking too deeply into the soft ground and extended stabilizer shaft 10 provides additional support and prevents the seat from tipping, shifting or falling over regardless of whether the user is actually sitting on the seat or not. The seat is completely self-stabilizing and does not require the user to utilize his or her legs to balance the seat in an upright weight-bearing position as is required with existing designs.

For use on impenetrable hard ground and floors, stabilizer feet 30 are fully extended perpendicular to main shaft 11. Seat frames 17 are then opposedly opened to present flexible seat member 20 in a weight-bearing position. Stabilizer shaft 10 is not extended as described above as the hard ground or floor will not allow for penetration of stabilizer shaft 10 as in soft ground applications.

The base of the seat, with stabilizer feet 30 fully extended, is then placed on the hard surface. The large extended stabilizer feet 30 maintain the seat in a very stable upright weight-bearing position. The seat is completely self-stabilizing and does not require any external support, by the user or otherwise, to maintain it in a stable upright weight-bearing position.

DESCRIPTION—FIGS. 6 & 7 b. Externally Mounted Stabilizer Shaft Configuration

Figure 6:
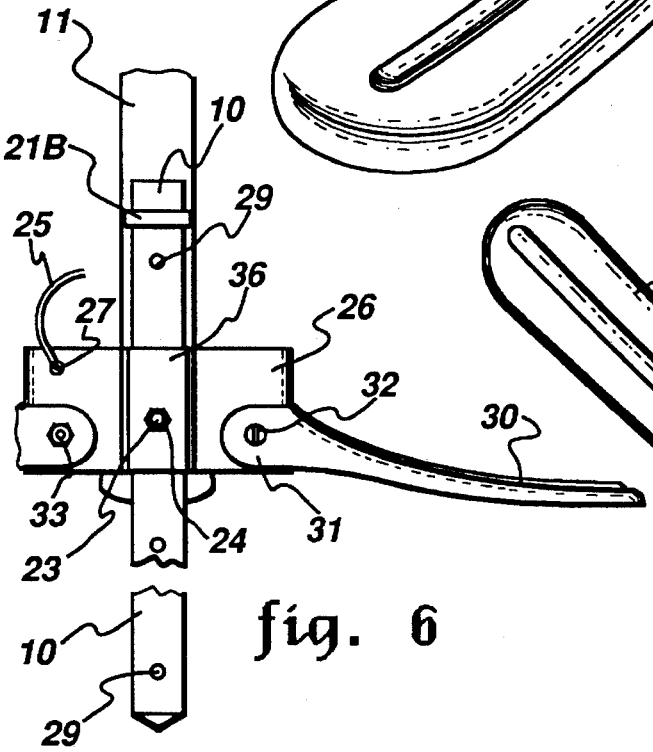
FIG. 6 is a partial side elevation of the lower portion of an alternative embodiment of the invention with the stabilizer shaft extendably mounted within the guide tube which is attached to the external surface of the lower end of the main shaft.
Figure 7:
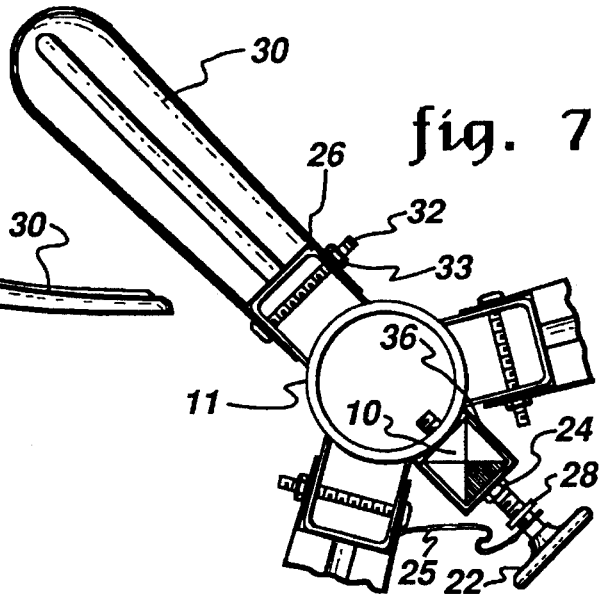
FIG. 7 is a bottom view, partially cutaway, of the alternative embodiment of the invention shown in FIG. 6.

An alternative embodiment of the present invention is shown in FIGS. 6 and 7. This embodiment comprises a main shaft 11 and a guide tube 36 which is attached by welding or other appropriate means, collaterally to the external surface of the lower end of main shaft 11.

Stabilizer shaft 10 is extendably mounted in guide tube 36 and is of a sufficiently small diameter to allow it to slide within guide tube 36 and extend beyond the base of main shaft 11 and stabilizer feet 30. As in the above described internally mounted stabilizer shaft configuration, the main shaft, guide tube and stabilizer shaft can have various cross-sectional shapes and different combinations of shapes can be used. In this embodiment, stabilizer shaft 10 is prevented from sliding completely out the lower end of guide tube 36 by a collar-like stop 21B which protrudes from the surface of the upper end of stabilizer shaft 10 and overlaps the walls of guide tube 36. The lower end of stabilizer shaft 10 is formed into a point to facilitate insertion into soft ground in appropriate conditions.

Stabilizer shaft 10 may be adjusted to a variety of degrees of fixed extension beyond the base of main shaft 11 and stabilizer feet 30 by means of cross bolt 22 as in the preferred embodiment, and a similar retention leash 25 prevents its loss. Guide tube 36 and main shaft 11 have concentric cross bolt holes 23 through which cross bolt 22 is inserted. Cross bolt nut 24 is attached to the external surface of guide tube 36 concentric with cross bolt holes 23. Cross bolt nut 24 allows cross bolt 22 to be removably inserted into guide tube 36 and main shaft 11. Stabilizer shaft 10 has a plurality of pairs of adjustment holes 29 along its length as in the preferred embodiment.

Cross bolt 22 and a portion of retention leash 25 are not shown in FIG. 6 in order to show the relationship of guide tube 36, stabilizer shaft 10 and cross bolt nut 24 to main shaft 11. FIG. 7 is a bottom view of the alternative embodiment of the invention and shows cross bolt 22 and retention leash 25 in place.

By removing and reinserting cross bolt 22 through cross bolt nut 24, cross bolt holes 23 and adjustment holes 29, stabilizer shaft 10 can be positively locked in a variety of positions ranging from fully retracted within main shaft 11 to fully extended beyond the base of main shaft 11 and stabilizer feet 30. By utilizing a square or other non-round configuration for guide tube 36 and stabilizer shaft 10, stabilizer shaft 10 cannot rotate within guide tube 36. As a result adjustment holes 29 automatically align with cross bolt holes 23 whether stabilizer shaft 10 is fully extended or retracted. See FIGS. 6 and 7.

A plurality of stabilizer foot brackets 26 are attached to the external surface of the lower end of main shaft 11 in multiple longitudinal planes as in the preferred embodiment. A stabilizer foot 30 is pivotally attached to each bracket 26 as in the preferred embodiment. By utilizing stabilizer foot brackets 26 to attach stabilizer feet 30 to the external surface of main shaft 11, stabilizer feet 30 can be attached in multiple longitudinal planes in order to stabilize the invention in all vertical planes. As a result when stabilizer feet 30 are extended perpendicular to main shaft 11 they form a large stable base which results in a self-stabilizing seat which does not require the user to utilize his or her legs to balance the seat in an upright weight-bearing position.

A folding seat is attached to the upper end of main shaft 11 as in the preferred embodiment.

OPERATION—FIGS. 6 & 7 b. Externally Mounted Stabilizer Shaft Configuration

The manner of using my seat in the externally mounted stabilizer shaft configuration in soft unstable ground conditions is to fully extend stabilizer feet 30 upward, perpendicular to main shaft 11. Cross bolt 22 is withdrawn from cross bolt nut 24 and cross bolt holes 23 in guide tube 36. This allows stabilizer shaft 10 to be extended the desired distance beyond the base of main shaft 11 and stabilizer feet 30.

A plurality of pairs of adjustment holes 29 along the length of stabilizer shaft 10 allow the user to vary the degree of fixed extension of stabilizer shaft 10 beyond the base of main shaft 11 and stabilizer feet 30 appropriate for existing ground conditions. This is done by simply reinserting cross bolt 22 into cross bolt nut 24 and cross bolt holes 23 so that it in turn passes through appropriate adjustment holes 29 in stabilizer shaft 10 to positively lock stabilizer shaft 10 in the desired position.

The softer and more unstable the ground is on which the invention is being used, the farther stabilizer shaft 10 is extended beyond the base of main shaft 11 and stabilizer feet 30 in order to provide increased support and stability. With stabilizer shaft 10 and stabilizer feet 30 fully extended, the invention provides a very stable base even on very soft, unstable ground.

Seat frames 17 are then opposedly opened to present flexible seat member 20 in a weight-bearing position. The base of the seat with stabilizer shaft 10 extended is then vertically thrust into the soft ground, snow, sand or mud a sufficient distance so that extended stabilizer feet 30 engage the soft surface. Stabilizer feet 30 prevent the seat from sinking too deeply into the soft ground and extended stabilizer shaft 10 provides additional support and prevents the seat from tipping, shifting or falling over regardless of whether the user is actually sitting on the seat or not. The seat is completely self-stabilizing and does not require the user to utilize his or her legs to balance the seat in an upright weight-bearing position as is required with existing designs.

For use on impenetrable hard ground and floors, stabilizer feet 30 are fully extended perpendicular to main shaft 11. Seat frames 17 are then opposedly opened to present flexible seat member 20 in a weight-bearing position. Stabilizer shaft 10 is not extended as described above as the hard ground or floor will not allow for penetration of stabilizer shaft 10 as in soft ground situations.

The base of the seat, with stabilizer feet 30 fully extended is then placed on the hard surface. Stabilizer feet 30 maintain the seat in a very stable upright weight-bearing position. The seat is completely self-stabilizing and does not require any external support, by the user or otherwise, to maintain it in a stable upright weight-bearing position.

From the description above, a number of advantages of my folding seat support become evident:

(a) My seat support can be used in swamps, mud, snow, sand and other soft, unstable ground conditions in which existing designs cannot.

(b) In addition, my seat support is adaptable for use on hard ground applications and floors and doesn't require the removal or addition of accessories in order to convert the seat from use on one ground surface to another.

(c) My seat support is completely self-stabilizing on both hard and soft ground conditions (d) My seat support does not require the user to utilize his or her legs to maintain it in an upright weight-bearing position.

(e) My seat support will not sink significantly under the user's weight when used on soft, unstable ground conditions such as found in marshes, swamps, surf zones, etc.

(f) My seat support will not fall over when the user stands up whether the seat is being used on hard or soft unstable ground conditions. This feature is especially critical when the seat is used in aquatic environments as other designs will sink and/or fall over and become submerged and/or lost.

(g) The large pivoting stabilizer feet on my support provide a large very stable base when extended and prevent the seat from sinking when used on soft, unstable ground conditions.

(h) The large stabilizer feet pivot downward so as to prevent the seat from becoming stuck when used on soft unstable ground conditions.

(i) The extended stabilizer feet also provide a large, very stable base when the seat is used on hard ground or floors which prevent the extension of the stabilizer shaft.

(j) My seat support has a retractable stabilizer shaft which when extended can be penetrated into soft, unstable ground to provide greatly increased support and stability.

(k) By using an appropriate combination of a square or other non-round stabilizer shaft, main shaft and/or guide tube, adjustment holes in the stabilizer shaft automatically align with the cross bolt holes in the main shaft and/or guide tube so that the stabilizer shaft can be easily and quickly extended beyond or retracted above the base of the main shaft and stabilizer feet.

SUMMARY, RAMIFICATIONS AND SCOPE

Accordingly, the reader will see that the above described invention can be used to provide an extremely stable seating platform in very unstable ground conditions. In addition my seat can also be used to provide a very stable seating platform on hard ground, floors and similar hard or firm surfaces. The invention is compact and light weight and is easily transportable. Furthermore my seat has the additional advantages in that:

—it provides a stable seating surface which is portable and easily moved from location to location;

—it is completely waterproof and weatherproof;

—it is completely self-stabilizing when used on hard surfaces as well as soft, unstable surfaces;

—a standard chair-type structure with both a back and a seat can be substituted for the seat frames and flexible seat member to provide a more comfortable seating structure;

—it does not require the addition or removal of accessories for use in different conditions;

—it provides an extremely stable seating surface in environments with unstable ground conditions such as swamps, snow, sand beaches and other areas typified by unstable ground conditions;

—it can also be used to provide a portable, easily stored seat for use on traditional hard ground or floor-like surfaces;

—it can be constructed from a variety of materials including but not limited to metal, plastic, fiberglass, composite materials such as graphite or any sufficiently rigid material;

—it does not require the user to utilize his or her legs to balance on top of the seat in order to maintain it in an upright, weight-bearing position.

Although the description above contains many specificities, these should not be construed as limiting the scope of the invention but merely as providing illustrations of some of the presently preferred embodiments of this invention. For example, the main shaft, stabilizer shaft and/or guide tube can have other shapes and combinations of shapes such as round, triangular, polygonal, etc., and the stabilizer feet can vary in size, shape, etc.

In addition, the invention could be used to provide stable support for purposes other than supporting a sitting human, such as a table or other work surface base; location markers; equipment mounting base such as for cameras, transits, etc.; support for portable structures such as blinds, etc.

Thus the scope of the invention should be determined by the appended claims and their legal equivalence, rather than by the examples given.

I claim:

1. A self stabilizing seat support comprising:

(a) an elongate, rigid, tubular, main shaft member having a hollow interior and being of sufficient length when vertically oriented to support a seated human;

(b) a plurality of elongate oblong stabilizer foot members;

(c) a plurality of stabilizer foot attachment means for pivotally connecting each of said elongate oblong stabilizer foot members to a lower end of said elongate rigid tubular main shaft member whereby the hollow interior of the main shaft member is not obstructed by said stabilizer foot attachment means;

(d) an elongate rigid stabilizer shaft member adapted for ground insertion which is of predetermined length and cross sectional size whereby said stabilizer shaft member can slide within and extend beyond the lower end of the hollow interior of the main shaft member;

(e) means for adjustably connecting said elongate rigid stabilizer shaft member to said elongate rigid tubular main shaft member whereby the stabilizer shaft member can be held in any of a plurality of positions relative to the main shaft member.

2. A self stabilizing seat support as in claim 1 wherein each of said stabilizer foot attachment means comprises a stabilizer foot bracket member, stabilizer foot hinge bolt and stabilizer foot nut which pivotally attaches a respective one of said elongate oblong stabilizer foot members to the exterior of the main shaft member.

3. The self stabilizing seat support of claim 2 wherein each of said stabilizer foot bracket members has a pair of coaxial holes which may receive said stabilizer foot hinge bolt and which said stabilizer foot hinge bolt is held in place by said stabilizer foot nut.

4. The self stabilizing seat support of claim 2 wherein each of said stabilizer foot bracket members has a lateral external surface.

5. A self stabilizing seat support as in claim 1 wherein each of the stabilizer foot members has a pair of parallel stabilizer foot ears extending from one end and wherein each ear has a hole coaxial with that of the other ear.

6. The self stabilizing seat support of claim 5 wherein said parallel stabilizer foot ears are spaced a sufficient distance apart wherein each pair of ears may straddle a respective one of said stabilizer foot bracket members such that the holes in the ears and the bracket members are aligned and capable of receiving said stabilizer foot hinge bolt.

7. The self stabilizing seat support of claim 5 wherein an inner edge connects said parallel stabilizer foot ears.

8. A self stabilizing seat support as in claim 1 wherein each of said stabilizer foot bracket members has an external surface and each of said stabilizer foot members has an inner edge, whereby when each of said elongate oblong stabilizer foot members are pivoted approximately perpendicular to the main shaft member said inner edge engages said lateral external surface and prevents further pivoting of said elongate oblong stabilizer foot member whereby a plurality of extended oblong stabilizer foot members provides a large stable base which when placed on a surface, stabilizes the main shaft member in an upright weight bearing orientation.

9. A self stabilizing seat support as in claim 1 wherein said elongate rigid tubular main shaft member has a square cross sectional shape.

10. A self stabilizing seat support as in claim 1 wherein said elongate rigid stabilizer shaft member is of square cross sectional shape whereby the stabilizer shaft can slide freely into and out of the hollow interior of the main shaft member but cannot be rotated within said hollow interior.

11. A self stabilizing seat support as in claim 1 wherein said means for adjustably connecting said elongate rigid stabilizer shaft member to said elongate rigid tubular main shaft member comprises:

a) a pair of coaxial cross bolt holes located in opposite sides of said elongate rigid tubular main shaft member;

b) a threaded cross bolt nut member attached to the external surface of said main shaft member such that its threaded void is coaxial with that of said cross bolt holes;

c) a plurality of pairs of coaxial adjustment holes in opposite sides of said elongate rigid stabilizer shaft member;

d) a threaded cross bolt member which may be passed through the main shaft member and stabilizer shaft member when said cross bolt holes and adjustment holes are aligned and threadingly received by said cross bolt nut;

e) a flexible retention leash means, one end of which is attached to the main shaft member and the other end of which is attached to the cross bolt member such that it does not interfere with the operation of the cross bolt yet prevents its loss.

* * * * *